United States Patent [19]

Rastatter

[11] 3,984,308

[45] *Oct. 5, 1976

[54] VORTICAL CYCLONE CLUSTER APPARATUS

[76] Inventor: Edward L. Rastatter, 340 E. 64th St. - 11F, New York, N.Y. 10021

[ * ] Notice: The portion of the term of this patent subsequent to Feb. 24, 1993, has been disclaimed.

[22] Filed: Jan. 19, 1976

[21] Appl. No.: 650,436

Related U.S. Application Data

[62] Division of Ser. No. 519,810, Nov. 1, 1974, Pat. No. 3,940,331.

[52] U.S. Cl. ..... 209/211

[51] Int. Cl.[2] ..... B04C 5/14

[58] Field of Search ..... 209/144, 211; 210/512 R, 512 M; 55/346–349

[56] References Cited

UNITED STATES PATENTS

| | | | |
|---|---|---|---|
| 3,061,994 | 11/1962 | Mylting | 55/346 |
| 3,598,731 | 8/1971 | Frykhult et al. | 210/512 M X |
| 3,764,006 | 10/1973 | Wikdahl | 209/211 |
| 3,785,489 | 1/1974 | Frykhult | 209/211 |
| 3,861,532 | 1/1975 | Skardal | 209/211 |
| 3,862,041 | 1/1975 | Robinson | 209/211 X |

*Primary Examiner*—Frank W. Lutter
*Assistant Examiner*—Ralph J. Hill
*Attorney, Agent, or Firm*—Jacox & Meckstroth

[57] ABSTRACT

A cluster of closely spaced cyclones are arranged with their axes in parallel spaced relation, and cylindrical portions of the cyclones form rigid connections between parallel walls which define a chamber for directing fluid into corresponding tangential inlets within the cyclones. In one embodiment, the walls are formed by flanges molded as integral parts of the plastic cyclone bodies, and the flanges are interconnected by key members. In another embodiment, the walls are formed by flat plates which are rigidly connected by independently removable molded plastic bodies having integral threads. Each of the cyclones includes a replaceable apex cone section which may be ceramic and has an externally threaded portion projecting into an apex discharge chamber defined between an inner wall and a parallel spaced transparent outer wall. Each apex cone section is secured to the inner wall by a nut member, and the transparent outer wall is provided with an axially aligned opening and valve for each cyclone for introducing a back flushing fluid or to produce a vacuum at the apex end. The apex cone sections may be secured to the apex discharge housing by threaded sleeves which also form spacers between the walls of the housing and which support corresponding transparent rings. A ceramic probe is adjustable axially within each ring and has a conical inner end which cooperates with the apex end of the corresponding cyclone to define an adjustable annular discharge orifice. The opposite ends of the cyclones have molded plastic closures with vortex finders which project into a vortex chamber defined by a removable cover member. The vortex finders may also project into a tank connected to a vacuum source for deaerating liquid which is received within the tank.

15 Claims, 7 Drawing Figures

VORTICAL CYCLONE CLUSTER APPARATUS

This is a division of application Ser. No. 519,810, filed Nov. 1, 1974, now U.S. Pat. No. 3,940,331.

BACKGROUND OF THE INVENTION

In the art of hydrocyclones, commonly referred to as cyclones, a free vortex principle is used for separating and classifying suspended solids, for example, to separate solids from water so that the water may be reused or for separating mud and slime from pulverized coal or for classifying oil drilling muds. Cyclones are also commonly used to separate sand, grit, bark particles and shives from cellulose fibers in the production of a paper making slurry.

In an effort to utilize more of the cellulose in trees, there is a trend in the paper making industry to chip whole trees including the trunks, branches and twigs. Since it is not practical to debark the branches and twigs, the bark is cooked with the chips and must be removed after cooking, even for grades of paper not generally requiring such cleaning. Since a cyclone becomes more efficient with respect to the removal of fine particles as the major diameter of the cyclone decreases, it has become desirable to employ a larger number of smaller cyclones such as cyclones having an inner diameter of six inches or less. The improved efficiency of the smaller cyclones may be partially sacrificed to permit a much lower pressure drop across the cyclones, and the lower pressure drop provides for a significant decreases in the energy required for operating the cyclones so that there is a significant savings in the cost of operating the cyclones, especially when millions of gallons of liquid or fluid are treated per day.

There have been a number of methods either used or proposed for assembling a group of relatively small cyclones into a cluster so as to minimize the space required by the assembly and to provide for a more compact and economic construction. For example, U.S. Pat. No. 3,335,860 disclose a cluster arrangement of cyclones which are arranged in a spoke type manner within a circular cast metal housing. Preferably, the cyclones disclosed in this patent are each formed of a ceramic material for obtaining a maximum service life. U.S. Pat. No. 3,415,374 discloses other cluster arrangements of hydrocyclones which are arranged either radially within an annular pattern or in a rectangular pattern with the axes of the cyclones in parallel relation. U.S. Pat. No. 3,543,931, which issued to the applicant of the present invention, shows another form of arranging cyclones in parallel spaced relation. In addition, a cluster arrangement of hydrocyclones is manufactured by A. B. Fractionator of Stockholm, Sweden and marked under the trademark "Albia 100." This cleaning device incorporates a cluster arrangement of tubular cyclones arranged in parallel relation. Each cyclone extends through a set of resilient ring seals mounted within aligned holes formed in parallel spaced plates or walls which define chambers therebetween in a manner similar to that shown in above U.S. Pat. No. 3,415,374.

SUMMARY OF THE INVENTION

The present invention is directed to an improved cyclone assembly which incorporates a cluster of relatively small cyclones assembled in a compact and economic manner and which also provides for conveniently observing the operation of each cyclone. The cluster cyclone assembly of the invention also provides for individual replacement of any cyclone which has had excessive wear and also incorporates the use of plastic and ceramic materials in a manner which minimizes both the cost of construction and the cost of maintenance. The invention further provides for a compact cluster arrangement which may be stacked as units and which is adapted for use in combination with a deaeration tank connected to a vacuum source to provide for discharging clean deaerated liquid from the cluster cyclone assembly.

In accordance with one embodiment of the invention, a plurality of cyclone bodies each includes a cylinder-cone portion which is molded of a rigid plastics material and is releasably coupled to an apex cone portion formed also of a rigid plastics or ceramic material. The cylinder-cone portion of each cyclone body is molded with outwardly projected integral flanges, and the corresponding flanges of adjacent bodies are rigidly connected by interfitting key members which are sealed by virtue of a modest plastic flow or with a suitable cement. The assembled cyclone bodies are enclosed within a canister to form a chamber through which the fluid is supplied to tangential inlets within the cyclone bodies. Thus the flanges of the cyclone bodies form generally parallel spaced walls which are rigidly connected by the cyclone bodies so that the fluid supply chamber may withstand substantial pressure. In another embodiment, the molded plastic cylinder-cone portions of the cyclone bodies are provided with integrally molded and axially spaced threads. The cyclone bodies extend through corresponding aligned holes formed within parallel spaced plates and are threadably secured to the plates so that the cone bodies form rigid connections between the plates defining the fluid supply chamber and may also be independently replaced.

The apex cone portions of the cyclones project into an apex discharge chamber which is defined between parallel spaced inner and outer plates or walls. The apex cone portions are secured to the inner wall by threaded nuts, and the outer wall is either transparent or includes transparent portions which provide for conveniently viewing the discharge of fluid from the apex end of each cyclone. The outer wall of the apex discharge chamber is also provided with openings or holes which are aligned axially with the cyclones and provide for ejecting a fluid into the apex end of each cyclone in the event the cyclone becomes blocked or clogged. The holes also provide for applying a suction to remove air from each cyclone. The invention further provides the feature of a ceramic probe for the apex end of each cyclone and which is adjustable axially to provide for precisely controlling an annular discharge orifice at the apex end of the cyclone. The adjustable probe also provides for adjusting this annular orifice to compensate for various pressure differentials for various sizes of suspended particles, and for wear of the apex orifice itself.

Other features and advantages of the invention will be apparent from the following description the accompanying drawing and the appended claims.

DESCRIPTION OF THE PREFERRED EMBODIMENTS

Figure 1:
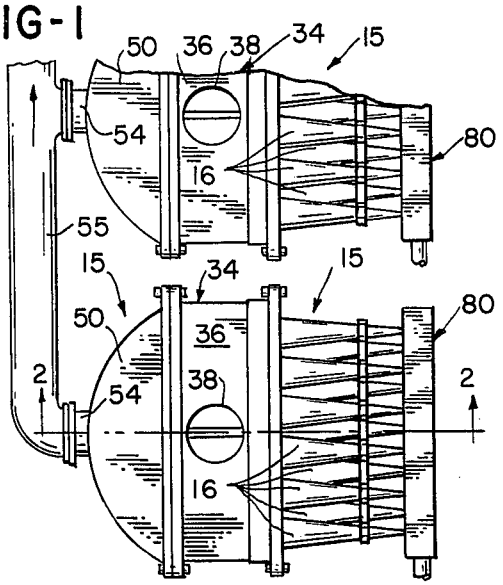
FIG. 1 is a plan view of one cluster cyclone assembly constructed in accordance with the invention and a fragment of an adjacent second assembly, with the common fluid supply manifold removed.

Referring to FIG. 1, each of the cyclone cluster assemblies or units 15 includes a cluster of hydrocyclones or cyclones 16. Since the units are identical in construction, only one will be explained in detail. Each of the cyclones 16 includes a hollow cyclone body formed by cylindrical portion 18 and a frusto-conical portion 24 and which is molded of a thermoplastics material such as nylon. A pair of axially spaced flanges 26 are molded as an integral part of each cyclone body at the opposite ends of the cylindrical portion 18, and each of the flanges 26 has a polygonal or hexagonal outer surface formed with a peripherally extending slot or groove 28.

Figure 2:
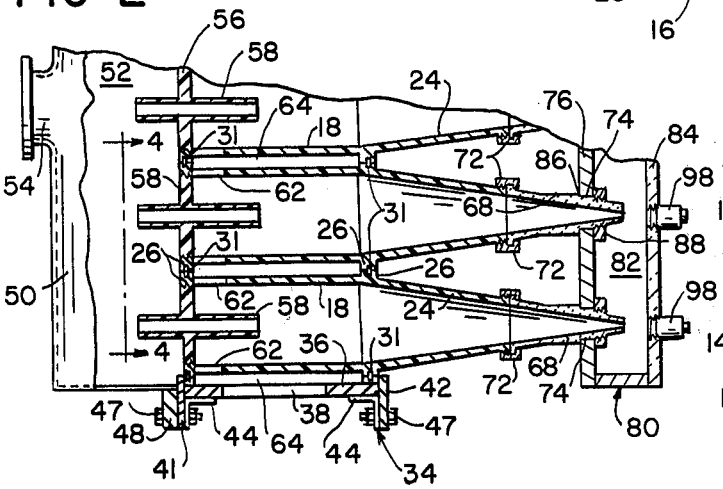
FIG. 2 is an enlarged vertical section taken generally on the line 2—2 of FIG. 1.

A set of elongated generally flat and interfitting key members 31 (FIG. 4) form a rigid connection between the cluster of closely spaced cyclone bodies. Each key member 31 projects into a set of opposing slots 28 formed within the abutting straight outer surfaces of the corresponding hexagonal flanges 26 of the adjacent cone bodies 18, as shown in FIG. 2. As the cone bodies are progressively assembled, a fluid sealant material or plastics cement may be coated within the grooves 28 and on key members 31 so that after all of the cone bodies are assembled, the mating corresponding hexagonal flanges 26 form two parallel spaced walls which are integrally and rigidly connected by the cylindrical portions 18 of the cone bodies. The fluid sealant and cement also cooperate with the key members to form a fluid-tight chamber between the axially spaced flanges 26 of the cone bodies.

In the embodiment illustrated in FIGS. 1–4, the cyclone bodies are assembled to form a cluster having a generally square or rectangular configuration. The flanges 26 of the outermost cyclone bodies within the cluster are connected by key members 31 and filler pieces (not shown) to provide the parallel spaced walls formed by the flanges 26 with either a square or rectangular outer peripheral surface. It is also within the scope of the invention to arrange the cluster of parallel cyclone bodies in a generally circular configuration, although the square or rectangular configuration is preferred for obtaining a more efficient use of the floor space.

The cylindrical portions 18 of the cluster assembly of cyclone bodies are surrounded by a correspondingly shaped four sided canister or housing 34 formed by four flat plates rigidly connected together. The plates may be of a heavy sheet plastics material or stainless steel clad metal plates. The upper plate 36 of each housing 34 is provided with a circular inlet 38 (FIG. 1), and the inlets 38 are connected to a manifold supply line or conduit (not shown) through which the fluid to be separated or classified is supplied to the cyclone cluster units 15. The walls of the canister housing 34 are connected to the flanges 26 of the outermost cyclone bodies and the filler pieces by a set of peripherally extending frame-like plates 41 and 42 and correspondingly adjacent angle strips 44.

A set of peripherally spaced bolts 47 rigidly connect each of the frames 41 and 42 to the corresponding adjacent angle strips 44. The bolts 47 which extend through the retaining frame 41 also secure the peripheral flange 48 of a cover member 50. The cover member 50 has a part cylindrical configuration and defines an "overflow" chamber 52 for receiving the fluid having the separated lighter fractions commonly referred to as "accepts." Each of the cover members 50 has a flanged outlet portion 54, and the outlet portions 54 are connected by a common discharge line or manifold 55.

The left end of each cyclone body 18 (FIG. 2) is provided with internal threads for receiving a corresponding closure member or plug 56 preferably also molded of a thermoplastics material such as nylon. Each of the closure plugs 56 has a centrally located vortex finder or overflow nozzle tube 58 which projects outwardly into the chamber 52 and inwardly into the center of the cylindrical portion 18 of the corresponding cyclone body. A set of diametrically opposed and tangentially extending slot-like inlets 62 are formed within the cylindrical portion 18 of each cyclone body adjacent the end flange 26 and provide for initiating the tangential flow of the supply fluid into each of the cyclones 16 from a supply chamber 64 defined between the cylindrical portions 18 of the cyclones, the axially spaced flanges 26 and the surrounding canister or housing 34.

Each of the cyclones 16 also includes an apex cone portion 68 which is preferably formed of an abrasive resistant material such as cast ceramic. Each of the cone portions 68 forms an extension of the frusto-conical portion 24, and an outwardly projecting flange is cast as an integral part of apex cone portion 68 for receiving an annular internally threaded coupling nut 72. The coupling nut 72 engages external threads molded as an integral part of the corresponding cyclone body or cemented onto the end of the body.

Figure 3:
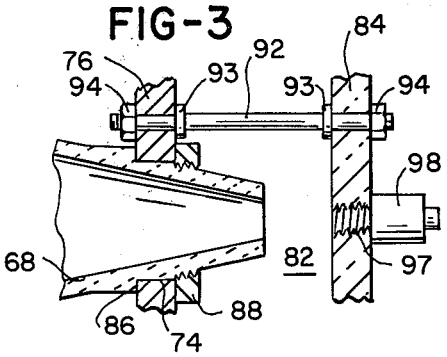
FIG. 3 is an enlarged fragmentary section showing the assembly of an apex cone portion to the apex discharging housing.

The apex cone portions 68 of the cyclones 16 project into corresponding circular openings or holes 74 formed within the flat inner wall 76 of a generally square or rectangular housing 80 defining an apex discharge chamber 82. The housing 80 includes an outer wall 84 which is preferably formed of a transparent plastics material and is positioned in parallel spaced relation to the inner wall 76. As shown in FIG. 3, an annular shoulder 86 is formed on each of the apex cone portions 68 and abuts the inner wall 76 of the discharge housing 80. A nut 88 engages threads formed as an integral part of the apex cone portion 68 and provides for rigidly securing the apex cone portion to the inner wall 76 of the discharge housing 80. If the apex cone portion 68 is formed of ceramic, the threads may be formed on a sleeve which is made of a material such as nylon and is cemented to the ceramic.

A plurality of spacer rods 92 (FIG. 3) extend between the inner wall 76 and the outer wall 84 of the apex discharge housing 80. Each of the spacer rods 92 includes a pair of rigidly connected collars 93 and is secured to the walls by a pair of nuts 94 to provide for a rigid connection between the walls of the housing and to maintain the parallel spaced relation in response to a differential pressure within the apex discharge chamber 82.

As is apparent from FIGS. 2 and 3, the apex ends of the cyclone 16 terminate within the chamber 82, and an axially aligned threaded opening 97 is formed within the outer wall 84 for each of the cyclones 16. A valve unit 98 is mounted within each of the openings 97 and preferably is in the form of either a check valve or a plug valve. In the event that the apex end of a cyclone becomes clogged or blocked, the corresponding valve 98 may be opened, and compressed air or water is directed inwardly into the end portion of the cyclone for releasing the blockage. The valves 98 may also be connected to a partial vacuum or suction source when it is desirable to apply a suction at the apex ends of the cyclones in a particular installation.

Figure 5:
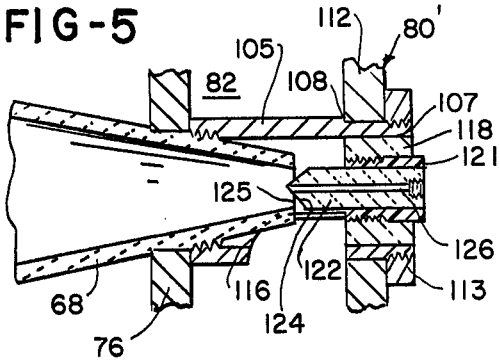
FIG. 5 is an enlarged section similar to FIG. 3 and showing a modification of the invention.

Referring to a modification shown in FIG. 5, the apex cone portions 68 of the cyclones 16 are each secured to the inner wall 76 of the discharge housing 80' by means of a tubular connecting cup or sleeve 105 which replaces the nut 88 referred to in connection with the embodiment shown in FIG. 3. Each of the cyclindrical sleeves 105 has an outer threaded end portion 107 which projects from an annular shoulder 108 through a corresponding cyclindrical opening within an outer wall 112 preferably formed of a thermoplastics material such as nylon in the same manner as the inner wall 76. A nut 113 secures the outer end portion 107 to the wall 112 so that the sleeve 105 not only serves to secure the apex cone portion 68 of each cyclone to the inner wall 76, but also serves to form a rigid connection and spacer between the inner wall 76 and the outer wall 112 of the apex discharge housing.

An opening or outlet 116 is formed within the bottom of each of the sleeves 105 to permit the fluid discharge from the apex end of the corresponding cyclone 16 to be directed into the apex discharge chamber 82 defined between the walls 76 and 112. A cylindrical cone ring 118 is formed of a transparent plastics material and is cemented within the outer end portion of the sleeve 105. The cone ring 118 has an internally threaded bore which receives an externally threaded tubular sleeve 121 preferably formed of a plastics material such as nylon. An elongated cylindrical probe 122 is preferably formed of a ceramic material and is secured to the sleeve 121 by a suitable cement. The probe 122 has an inner conical end surface 124 which cooperates with the circular opening within the end of the apex cone portion 68 to define an annular discharge orifice which may be varied by adjusting the probe 122 and sleeve 121 axially.

An axially extending passage 126 extends through the center of the probe 122 and has an outer end which is normally closed by a valve (not shown) similar to the valve 98 referred to above in connection with FIG. 3. The passage 126 provides for injecting a fluid such as water into the apex cone portion 68 in the event of a blockage or to provide for creating a partial vacuum within the apex end of the cyclone by connecting the passage 126 to a suction source.

Figure 6:
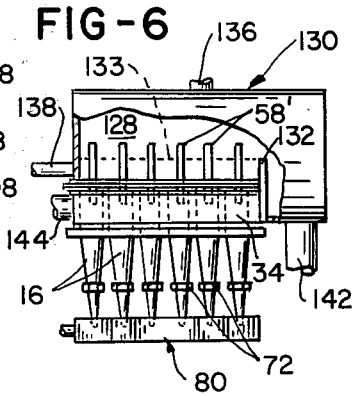
FIG. 6 is an elevational view of a cyclone assembly constructed in accordance with the invention and illustrating its use with a deaeration tank.

Referring to FIG. 6, a cluster of cyclones 16 are arranged with their axes vertical instead of horizontal as illustrated in FIGS. 1–5, and the vortex finder tubes 58' project upwardly into a vacuum chamber 128 defined by a part cylindrical vacuum tank 130. A vertical dam member 132 provides for collecting liquid within the tank 130 to a level where the liquid overflows the dam member 132. The tank 130 is connected by line 136 to a vacuum source and is maintained at a negative pressure which is substantially near the boiling point of the liquid, for example 69 cm. Hg. so that the vacuum chamber 128 functions to deaerate the liquid which is sprayed against the upper wall of the tank from the vortex finder tubes 58'. The deaerated liquid is directed through a discharge line 138 to a receiving apparatus, as for example, the head box of a paper making machine. The liquid which overflows the dam member 132 is collected within the bottom end portion of the tank 130 and is directed by a line 142 back to the suction of a pump which supplies the fluid to the canister inlet 38 of the cyclone cluster assembly 15.

Figure 7:
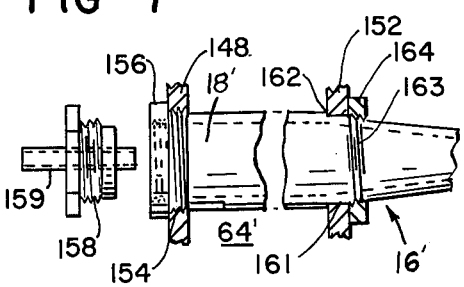
FIG. 7 is a partially exploded fragmentary section illustrating another form of cyclone cluster assembly in accordance with the invention.

A modified form of cyclone cluster assembly 15 is illustrated in FIG. 7. In this embodiment, the feed or supply chamber 64 is defined between parallel spaced plates 148 and 152 which may be formed of a noncorrosive plastics material such as nylon. The walls or plates 148 and 152 are rigidly connected together by the cylindrical body portions 18' of the cyclone 16'. The plate 148 is provided with a threaded opening 154 for each of the cyclones 16' and corresponding mating threads are molded as an integral part of a cyclone body portion 18'. An outwardly projecting peripheral flange 156 is also molded as an integral part of each cyclone body and is provided with internal threads for receiving a closure plug 158 also preferably molded of thermoplastics material such as nylon, and having an integral vortex finder tube 159. The opposite end of the cylindrical body portion 18' projects through a corresponding cylindrical opening 161 within the wall or plate 152 and has an annular shoulder 162 which abuts the wall 152. Threads 163 are molded as an integral part of the cyclone body portion 18' and receive a nut 164 which cooperates with the shoulder 162 to secure the cyclone 16' rigidly to the wall or plate 152. Thus the cylindrical portions 18' of the cyclone bodies form a combined spacing and coupling member for rigidly connecting and positioning the walls or plates 148 and 152 so that the supply chamber 64 defined between the plates 148 and 152 can withstand substantial pressure.

Figure 4:
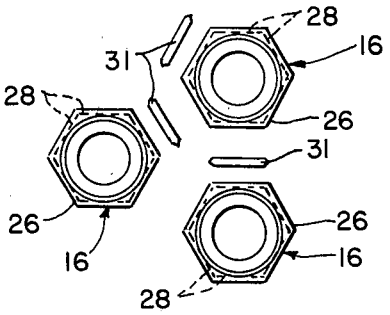
FIG. 4 is an exploded view of a portion taken generally on the line 4—4 of FIG. 2 and illustrating the use of interfitting key members for interconnecting the cyclone bodies in a compact assembly.

From the drawing and the above description, it is apparent that a cyclone cluster assembly construction in accordance with the present invention, provides desirable features and advantages. For example, by constructing the cyclones 16 as shown in FIGS. 2 and 4 or as shown in FIG. 7, the cyclones may be arranged in a closely spaced compact relation so that a large number of cyclones may be assembled within a minimum of space. The parallel spaced walls formed by the inter connected flanges 26 of the embodiment shown in FIGS. 2 and 4 or the walls formed by the plates 148 and 152 of the embodiment shown in FIG. 7 are rigidly connected or coupled together by the cyclones 18 or 18'. As a result, there is no need to provide for separate tie bolts and spacer members, and the cyclones may be arranged closer together.

In a similar manner, the connecting cups or sleeves 105 illustrated in FIG. 5 serve not only to form a rigid connection between the cyclone bodies and the inner wall 76 of the discharge housing 80, but also to form spacers and rigid connections between the inner wall 76 and the outer wall 112.

It is also apparent that ecah compact cluster unit of cyclones may be preassembled and pressure tested at the manufacturing plant and then shipped to the user's plant where the units may be quickly connected to the proper manifolds. As mentioned above, the cluster cone units may also be stacked to conserve floor space.

Another feature is provided by the use of the axially adjustable ceramic probe 122 with each cyclone, as described in connection with FIG. 5. This probe provides for precisely controlling the size of the discharge orifice 125, especially as the apex end wears, and thereby provides for precisely controlling the discharge from the apex of each cyclone. In addition, the transparent cone ring 118 provides for visually inspecting the discharge flow from each cyclone in the same manner as provided by the transparent outer wall 84 of the apex discharge housing 80. As illustrated in FIG. 6, the compact cyclone cluster assembly 15 of the invention is also adapted for use in combination with a deaerating device or tank 130, and the size of the tank is minimized as a result of the compact arrangement of the cyclones 16.

While the forms of apparatus herein described constitute preferred embodiments of the invention, it is to be understood that the invention is not limited to these precise forms of apparatus, and that changes may be made therein without departing from the scope and spirit of the invention as defined in the appended claims.

The invention having thus been described, the following is claimed:

1. A cyclone assembly comprising a cluster arrangement of elongated hydrocyclones each including a rigid tubular inlet portion and a generally conical portion having an apex end portion defining an outlet, wall means connected to said hydrocyclones at axially spaced locations, a casing cooperating with said wall means to define a liquid supply chamber, means for directing a liquid into said supply chamber, means forming an axially extending vortex passage for each of said hydrocyclones, means defining a generally tangential inlet within said inlet portion of each said hydrocyclone for directing the liquid from said supply chamber into said inlet portion of each said hydrocyclone, housing means connected to said apex end portions of said hydrocyclones and defining an outlet chamber for receiving the fluid discharged from said outlets, means supported by said housing means in generally axial alignment with said apex end portion of each said hydrocyclone and defining a passage for injecting a fluid through the corresponding said outlet of each said hydrocyclone, and means for closing each said passage.

2. A cyclone assembly as defined in claim 1 wherein said means defining said passage for each said hydrocyclone, comprise a valve having a movable valve member.

3. A cyclone assembly as defined in claim 1 wherein said means defining said passage for each said hydrocyclone, comprise a tubular probe member having an inner end surface cooperating with said apex end portion to define a corresponding annular said outlet, and means for adjusting said probe member axially for precisely selecting the size of said outlet.

4. A cyclone assembly as defined in claim 1 wherein said housing means comprise spaced inner and outer walls, a tubular sleeve member for each said hydrocyclone and having means for securing the corresponding said apex end portion to said inner wall, and each said sleeve member includes means for rigidly connecting said inner and outer walls and for forming a spacer therebetween.

5. A cyclone assembly as defined in claim 4 wherein each said sleeve member includes axially spaced circumferential threads for connecting said sleeve member to said inner and outer walls.

6. A cyclone assembly comprising at least one elongated hydrocyclone including a rigid tubular inlet portion and a generally conical portion having an apex end portion defining an outlet, wall means connected to said hydrocyclone at axially spaced locations and defining a liquid supply chamber therebetween, means for directing a liquid into said supply chamber, means forming an axially extending vortex passage for said hydrocyclone, means defining a generally tangential inlet within said inlet portion of said hydrocyclone for directing the liquid from said supply chamber into said inlet portion of each said hydrocyclone, housing means connected to said apex end portion of said hydrocyclone and defining an outlet chamber for receiving the fluid discharged from said outlet, means supported by said housing means in generally axial alignment with said apex end portion of said hydrocyclone and defining a passage for injecting a fluid through the corresponding said outlet of said hydrocyclone, and means for closing said passage.

7. A cyclone assembly as defined in claim 6 wherein said means defining said passage for said hydrocyclone, comprise a tubular probe member having an inner end surface cooperating with said apex end portion to define an annular said outlet, and means for adjusting said probe member axially for precisely selecting the size of said outlet.

8. A cyclone assembly comprising a cluster arrangement of elongated hydrocyclones each including a rigid tubular inlet portion and a generally conical portion having an apex end portion defining an outlet, wall means connected to said hydrocyclones at axially spaced locations, a casing cooperating with said wall means to define a liquid supply chamber, means for directing a liquid at a substantial hydraulic pressure into said supply chamber, means forming an axially extending vortex passage for each of said hydrocyclones, means defining a generally tangential inlet within said inlet portion of each said hydrocyclone for directing the liquid from said supply chamber into said inlet portion of each said hydrocyclone, housing means connected to said apex end portions of said hydrocyclones and defining an outlet chamber for receiving the fluid discharged from said outlets, said housing means including spaced inner and outer walls, a tubular sleeve member for each said hydrocyclone and having means for securing the corresponding said apex end portion to said inner wall, and each said sleeve member includes means for rigidly connecting said inner and outer walls and for forming a spacer therebetween.

9. A cyclone assembly as defined in claim 8 wherein each said sleeve member includes axially spaced circumferential threads for connecting said sleeve member to said inner and outer walls, and means on each said sleeve member defining a port for connecting said outlet to said outlet chamber.

10. A cyclone assembly as defined in claim 8 and including a transparent closure element connected to each said sleeve member.

11. A cyclone assembly as defined in claim 10 including means within each said closure element for defining a passage aligned generally axially with said outlet of the corresponding said hydrocyclone.

12. A cyclone assembly comprising a first wall member and a second wall member disposed in substantially parallel relation, means defining a plurality of corresponding sets of generally aligned openings within said first and second wall members, a cluster arrangement of elongated hydrocyclones having longitudinally extending substantially parallel axes, each of said hydrocyclones including a frusto conical portion having an apex end portion defining an outlet, each said hydrocyclone extending between a corresponding set of openings within said first and second wall members, a casing cooperating with said first and second wall members to define a liquid supply chamber, means for directing a liquid at a predetermined hydraulic pressure into said supply chamber, means forming an axially extending vortex passage for each of said hydrocyclones and projecting through the corresponding said opening within said first wall member, means defining a generally tangential inlet within each said hydrocyclone for directing the liquid from said supply chamber into said hydrocyclone, means for rigidly securing each said hydrocyclone to said first and second wall members for causing said hydrocyclones to form rigid connections between said first and second wall members to provide for withstanding the hydraulic pressure of the liquid within said supply chamber, and outlet housing means connected to said apex end portions of said hydrocyclones and defining an outlet chamber for receiving the fluid discharged from said outlets.

13. A cyclone assembly as defined in claim 12 wherein said outlet housing means comprise a generally planar outer wall member, and means defining a generally axially aligned passage within said outer wall member for each of said hydrocyclones.

14. A cyclone assembly as defined in claim 13 wherein said means defining said passage for each said hydrocyclone comprise a corresponding axially adjustable probe member having an inner surface cooperating with said apex end portion to define an annular said outlet.

15. A cyclone assembly as defined in claim 12 wherein said outlet housing means comprise a generally planar outer wall member, and a corresponding tubular sleeve member for rigidly connecting each said hydrocyclone to said outer wall member.

* * * * *